US005718214A

United States Patent [19]

Altman et al.

[11] Patent Number: 5,718,214

[45] Date of Patent: Feb. 17, 1998

[54] COMBINATION BLOW DART GUN AND DARTS

[76] Inventors: Timothy H. Altman, 9751 Richmond La.; William E. Brandt, 7027 Nova Scotia Dr., both of Port Richey, Fla. 34668

[21] Appl. No.: 545,338

[22] Filed: Oct. 19, 1995

[51] Int. Cl.[6] ..... F41B 1/00

[52] U.S. Cl. ..... 124/62; 273/422

[58] Field of Search ..... 124/62; 273/422

[56] References Cited

U.S. PATENT DOCUMENTS

| | | | |
|---|---|---|---|
| 278,005 | 5/1883 | Fredricks et al. | 124/62 |
| 632,526 | 9/1899 | Hervey | 124/62 |
| 1,545,794 | 7/1925 | Quinn | 124/62 |
| 2,679,838 | 6/1954 | Thompson | 124/62 |
| 3,685,828 | 8/1972 | Getgey et al. | 124/62 X |
| 4,419,978 | 12/1983 | Loftus | 124/62 |
| 4,537,176 | 8/1985 | Stravitz et al. | 124/62 |
| 4,586,482 | 5/1986 | DiPietro | 124/62 |
| 5,192,081 | 3/1993 | Cooper | 273/422 |

FOREIGN PATENT DOCUMENTS

| | | | |
|---|---|---|---|
| 693251 | 11/1930 | France | 124/62 |
| 3150771 | 6/1983 | Germany | 124/62 |
| 3724548 | 6/1988 | Germany | 124/62 |

*Primary Examiner*—John A. Ricci

[57] ABSTRACT

A blow dart gun and darts for use therewith, the blow dart gun having movable grips and a single-piece quiver attached to the outer surface of an elongated tube. Shims are used to secure the movable grips and the single-piece quiver to the outer surface of the blow dart gun tube. At one end of the elongated tube is a mouthpiece having an inner tapered portion to prevent a dart from coming in contact with the mouth of a user. At the other end of the elongated tube is a hinged tube cover to protect the inside surface of the elongated tube during periods of non-use. Darts for use in the blow dart gun have a dart tip groove for easier removal from a target, a non-flanged rear portion, and threads to securely attach the dart tip to the remainder of the dart.

10 Claims, 5 Drawing Sheets

COMBINATION BLOW DART GUN AND DARTS

BACKGROUND

1. Field of Invention

This invention relates to air-operated devices for propelling darts, specifically to a blow dart gun with an elongated tube having a mouthpiece with a tapered inner portion, movable grips, and a single-piece quiver for holding darts which have a non-flanged rear portion, a groove thereon for easier removal from a target, and threaded means for secure attachment of the dart tip to the remainder of the dart.

2. Description of Prior Art

It is well known to have air-operated devices for propelling darts. Ancient indian cultures are known to have used reeds and projectiles blown therefrom by mouth for hunting purposes. It is also known for veterinarians and animal handlers to use innoculating darts propelled from blow guns to tranquilize dangerous animals. Further, it is known to have toy guns with air compression chambers for launching a variety of projectiles.

The prior art most closely related to the present invention is the invention disclosed in U.S. Pat. No. 3,735,748 to Gaylord (1973). The Gaylord invention contemplates an elongated blow dart gun tube with a plurality of magnets secured thereto for holding darts having pointed metallic rods attached to slotted, cylindrical body sections. Both the design of the Gaylord darts and their attachment to the Gaylord blow gun tube by means of magnets are different from the present invention. The Gaylord blow dart gun does not have a mouthpiece with an inner tapered portion, nor does it have movable grips or a single-piece quiver. It is known to have multi-piece quivers attached to blow dart gun tubes. The disadvantage of multi-piece quivers is that its individual components may become misaligned during use, causing the darts to fall out of the multi-piece quiver.

SUMMARY OF INVENTION—OBJECTS AND ADVANTAGES

It is the primary object of this invention to provide a blow dart gun having an elongated tube with a single-piece quiver attached thereto so that darts will remain securely attached to it during use. It is also an object of this invention to provide a blow dart gun with movable grips so that the user may adjust the grips during use. A further object of this invention is to provide a dart for use in the blow dart gun which has a groove for easier removal from a target. It is also an object of this invention to provide a dart having a tip with threads for secure attachment to the remainder of the dart. It is also an object of this invention to provide a dart having a non-flanged rear portion that is not as easily broken as are the rear portions of flanged darts.

As described herein and properly manufactured, the present invention would provide a blow dart gun having a single-piece quiver attached thereto. Since portions of the single-piece quiver would be attached to the present invention to not move relative to each other during use, darts would remain securely in place on the one-piece quiver. Movable grips would allow the user to obtain a better grip around the outside surface of the elongated tube during use. A dart lock would hold a dart in place within the elongated tube prior to use, and allow easy release of the dart for immediate use on demand. When the dart lock is spring activated, a quick movement of a finger pushing against the dart lock will release a dart for use. The dart of the present invention has a groove on its tip for easier removal from a target. The dart contemplated by the present invention also has a tip with threaded means for secure attachment to the remainder of the dart. Undersized threads on the dart body would allow for an even more secure attachment of the mating threads on the dart tip. The dart of the present invention also has a non-flanged rear portion which is not as easily broken as are the rear portions of commonly used flanged darts when contacted by rearwardly approaching subsequently thrown darts.

The description herein provides preferred embodiments of the present invention but should not be construed as limiting the scope of the blow dart gun invention. Variations in the tapering and the length of the elongated tube, the material from which the grips are made, the size and shape of the scope, the height adjusting means for the scope, the size and shape of the single-piece quiver, the number of darts that the single-piece quiver will hold, the size and shape of the mouthpiece, and the positioning and locking means of the dart lock, other than those shown, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
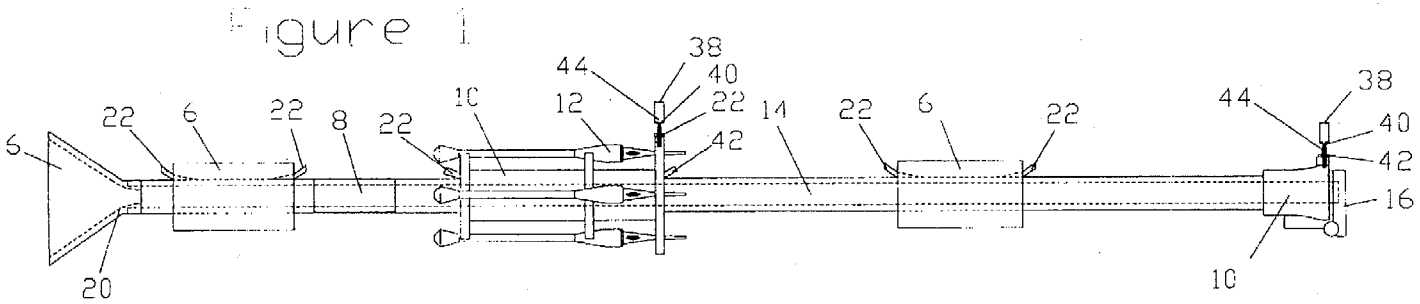
FIG. 1 is a side view of a first embodiment of the invention having darts attached thereto in a single-piece moveable quiver.

FIG. 1 shows the blow dart gun invention 2 having a mouthpiece 4 connected to one end of an elongated tube 14. The portion of mouthpiece 4 which fits inside tube 14 is tapered so that a dart 12 placed inside tube 14 may not come in contact with a user's mouth (not shown). A hinged cover 16 closes the other end of tube 14 to protect the inside surface of tube 14 during periods of non-use. A single-piece movable quiver 10 is attached to the outside surface of tube 14. FIG. 1 shows darts 12 attached to single-piece movable quiver 10 and shims 22 inserted between single piece movable quiver 10 and the outside surface of tube 14 to securely position single-piece movable quiver 10 against tube 14. In addition, FIG. 1 shows a warning label 8 and two movable grips 6 attached to the outside surface of tube 14. Shims 22 may also be used to securely position movable grips 6 against the outside surface of tube 14. Although the preferred embodiment shown in FIG. 1 has two movable grips 6, the number of movable grips 6 is not critical to blow dart gun invention 2. It is contemplated for blow dart gun invention 2 to also have as few as one movable grip 6, or many movable grips 6.

Figure 2:
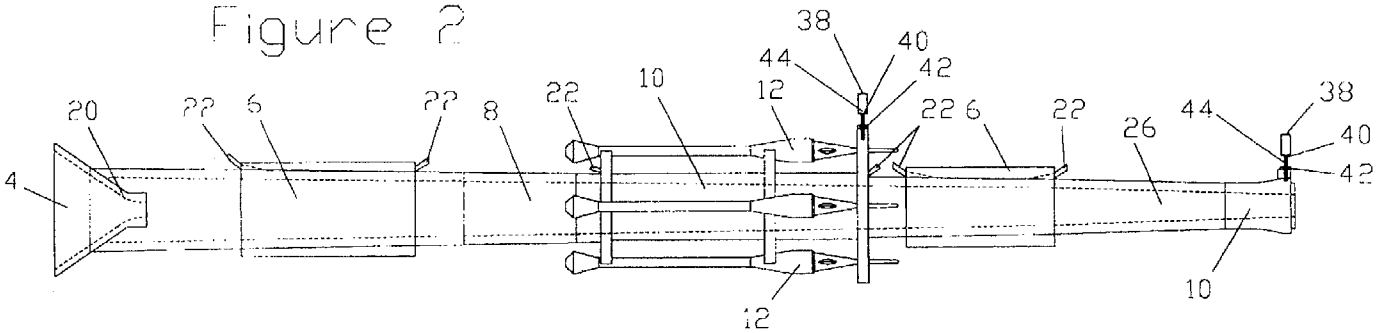
FIG. 2 is a side view of a second embodiment of the invention having a tapered blow dart tube.
Figure 3:
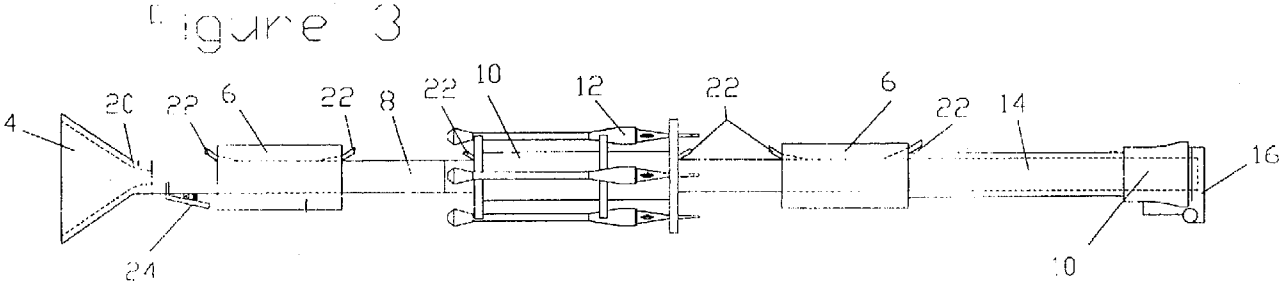
FIG. 3 is a side view of a third embodiment of the invention having a dart locking mechanism.
Figure 4:
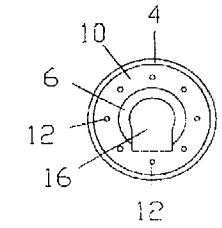
FIG. 4 is a front view of the invention.
Figure 6:
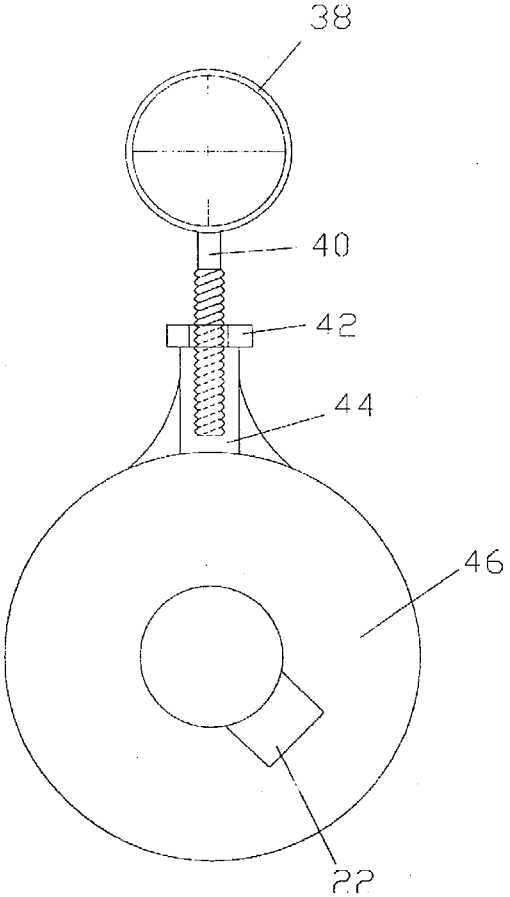
FIG. 6 is a rear view of the scope and single-piece movable quiver.
Figure 5:
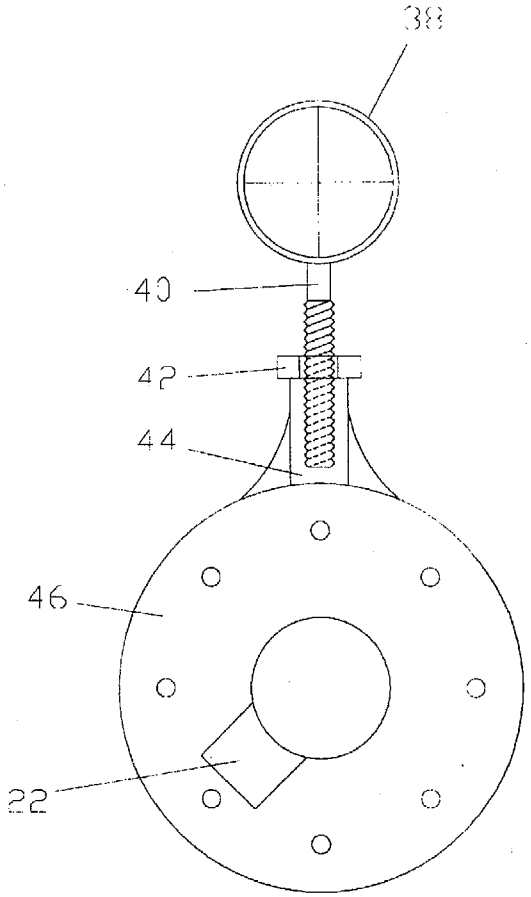
FIG. 5 is a front view of the scope and single-piece movable quiver.
Figure 7:
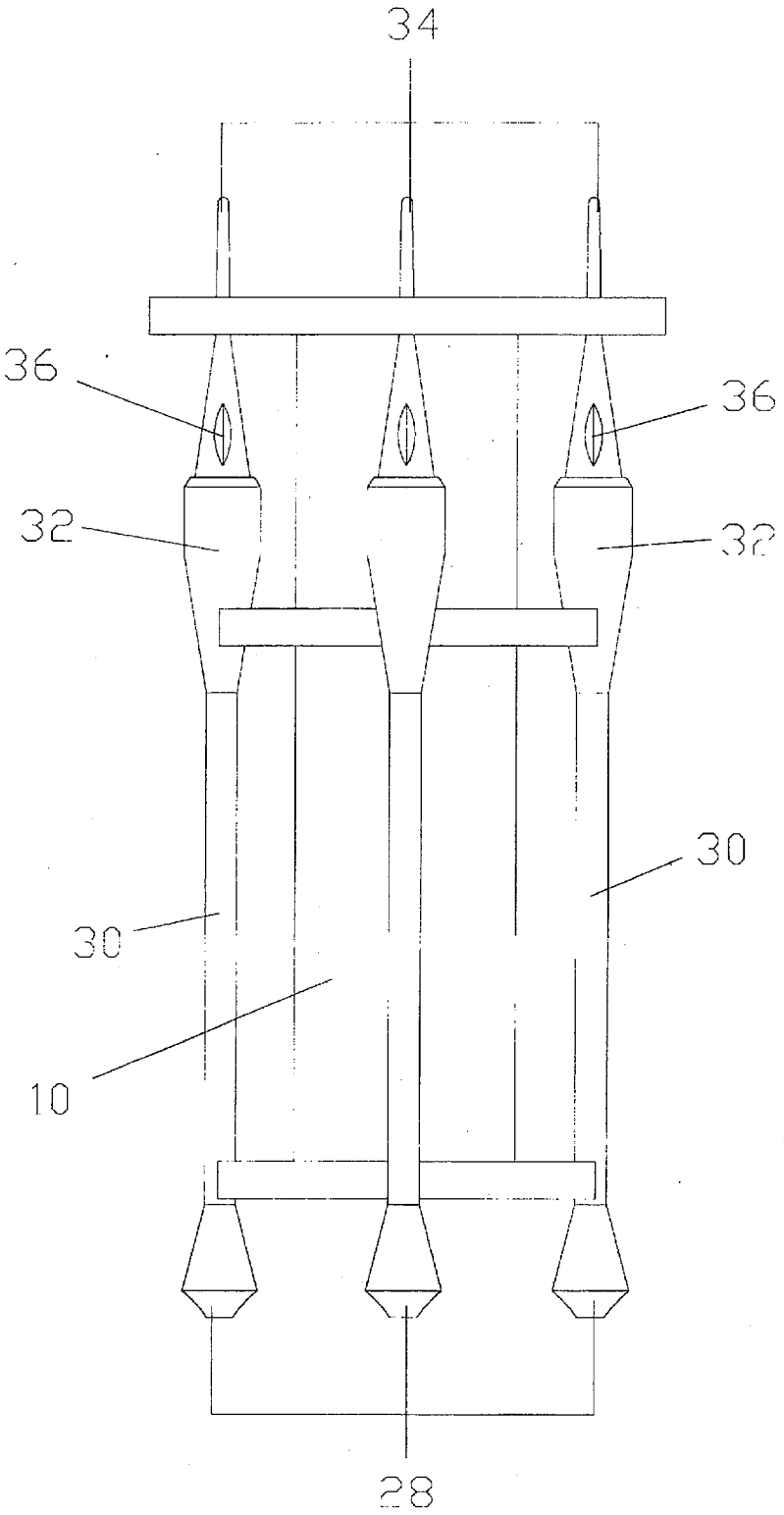
FIG. 7 is a side view of the single-piece movable quiver containing darts.
Figure 8:
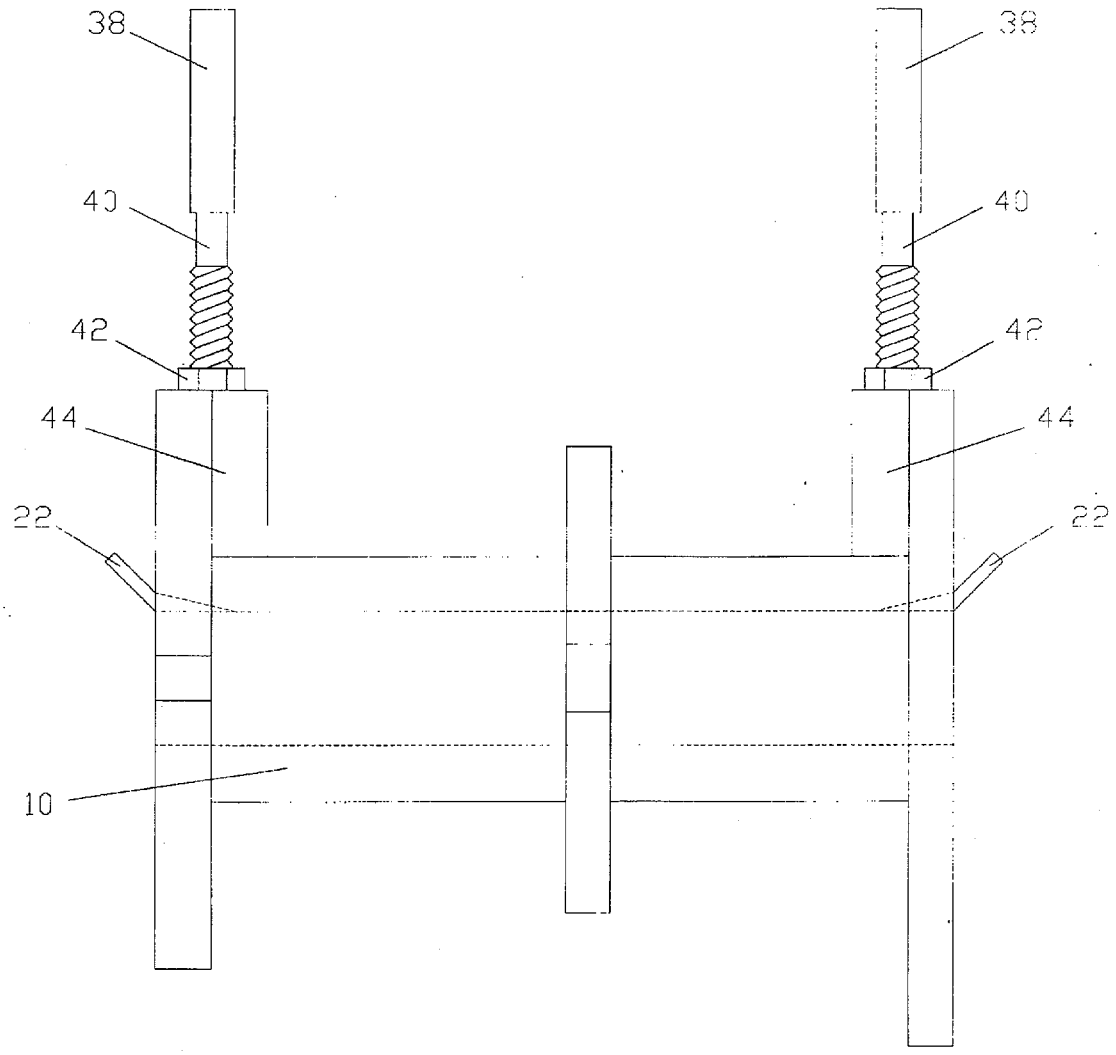
FIG. 8 is a view of the scope and single-piece movable quiver.

FIGS. 2, 3, and 4 also show the attachment of single-piece movable quiver 10 and grips 6 to blow dart gun invention 2. In addition, FIG. 2 shows blow dart gun invention 2 having a tapered tube 26 which allows for increased exit speed of darts 12 from the small end of tube 26. Further, FIG. 3 shows blow dart gun invention 2 having a dart lock 24 which holds dart 12 inside tube 14 prior to use. In the preferred embodiment it is contemplated for dart lock 24 to be spring activated so that darts 12 may be quickly and easily released for use. FIG. 4 shows hinged end cover 16 closing one end of tube 14.

FIGS. 5, 6, 7, and 8 show single-piece movable quiver 10 and a scope with cross hairs 38 in greater detail. In the preferred embodiment the height of scope with cross hairs 38 is adjusted by a bolt 40 secured by a nut 42 within a shaft 44 which is attached to single piece movable quiver 10.

Figure 9:
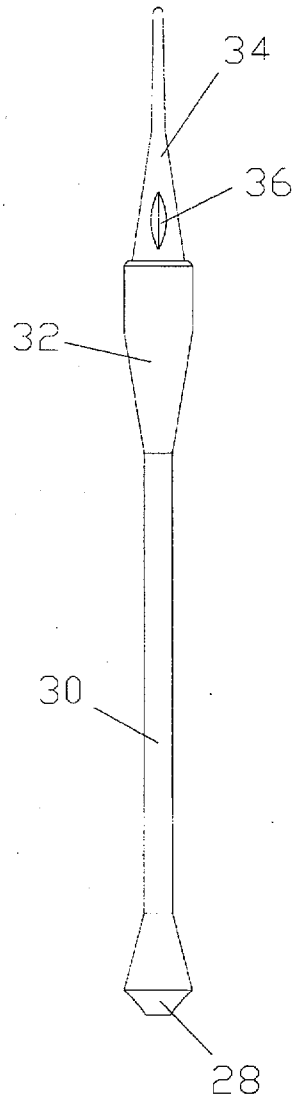
FIG. 9 is a side view of a dart for use in the single-piece movable quiver.
Figure 10:
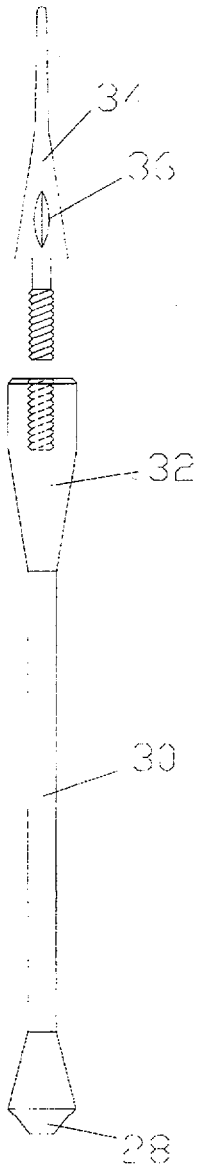
FIG. 10 is an exploded view of a dart for use in the single-piece movable quiver.

FIGS. 9 and 10 show darts 12 having a pointed dart tip 34, a dart tip holder 32, an elongated dart shaft 30 and a non-flanged rear portion 28. Dart tip 34 has a groove for easy removal from a target Dart tip 34 also has a threaded end to allow secure threaded attachment to dart tip holder 32. In the preferred embodiment, threads on dart tip holder 32 are slightly smaller than threads on dart tip 34 for additional attachment security. Dart shaft 30 is positioned between dart tip holder 32 and non-flanged rear portion 28.

What is claimed is:

1. A blow dart gun for use with darts having a dart tip, a dart tip holder, an elongated shaft and a non-flanged rear portion, said blow dart gun comprising an elongated tube having an outside surface, opposite ends, and a center bore with a diameter slightly larger than the widest portion of said darts, said blow dart gun also comprising a mouthpiece attached to one of said opposite ends, a single-piece quiver attached to said outside surface, said single-piece quiver having attachment means thereon to securely hold said darts, and said blow dart gun further comprising a plurality of movable grips attached to said outside surface of said elongated tube.

2. The blow dart gun of claim 1 further comprising a plurality of shims for use in securely positioning said movable grips and said single-piece quiver against said outside surface of said elongated tube.

3. A dart in combination with the blow gun of claim 1, said dart comprising a dart tip having a groove therein for easy removal of said dart from a target, a dart tip holder connected to said dart tip by threaded means for secure attachment of said dart tip to said dart tip holder and ease in replacing said dart tip should it break, a shaft having two opposite ends, one of said opposite ends of said shaft connected to said dart tip holder, and a non-ranged rear portion connected to said other end of said shaft to reduce damage to said dart as a result of contact with rearwardly approaching subsequently thrown darts.

4. The dart and blow gun combination of claim 3 wherein said threaded means comprises threads on said dart tip which are slightly oversized relative to said mating threads on said dart tip holder so as to provide enhanced attachment of said dart tip to said dart tip holder during impact with a target.

5. The blow dart gun of claim 1 wherein said elongated tube is tapered, having a wider inner bore on said opposite end adjacent to said mouthpiece and a smaller inner bore on said opposite end remote from said mouthpiece, and wherein said quiver is movably attached to said outside surface.

6. The blow dart gun of claim 1 further comprising a tapered inner mouthpiece attached between said mouthpiece and said elongated tube and a dart lock connected through said outside surface adjacent to said inner mouthpiece.

7. The blow dart gun of claim 6 wherein said dart lock comprises spring means attached thereto for quick release of said darts.

8. The blow dart gun of claim 1 further comprising a plurality of scopes attached to said single-piece quiver.

9. The blow dart gun of claim 8 wherein each of said scopes has cross-hairs and each of said scopes is attached to said single-piece quiver with height adjusting means comprising bolts secured by nuts, each bolt being movable within a vertical shaft.

10. The blow dart gun of claim 1 further comprising a hinged end cover, said end cover having sufficient size to completely cover said bore of said opposite end of said elongated shaft remote from said mouthpiece to prevent foreign objects from entering said bore during periods of non-use.

* * * * *